United States Patent [19]

Barlogis

[11] 4,379,516

[45] Apr. 12, 1983

[54] DEVICE FOR DISPENSING FUSED MATERIALS SUCH AS THERMOPLASTIC ADHESIVES

[75] Inventor: Rene Barlogis, Vagney, France

[73] Assignee: Societe Francaise d'Agrafage Industriel - Sofragraf, Vagney, France

[21] Appl. No.: 215,739

[22] Filed: Dec. 12, 1980

[30] Foreign Application Priority Data

Dec. 14, 1979 [FR] France ..... 79 30718

[51] Int. Cl.[3] ..... B67D 5/62

[52] U.S. Cl. ..... 222/146 HE; 222/391; 279/46 R; 279/15 G

[58] Field of Search ..... 222/146 H, 146 HE, 391; 228/52, 53; 401/1; 226/162, 167; 279/46 R, 15 G

[56] References Cited

U.S. PATENT DOCUMENTS

| | | | |
|---|---|---|---|
| Re. 27,828 | 12/1973 | Salonen | 222/146 HE |
| 3,314,574 | 4/1967 | Longval et al. | 222/146 HE |
| 3,964,644 | 6/1976 | Wallace | 222/146 HE |
| 4,090,643 | 5/1978 | Wilkinson et al. | 222/146 HE |

*Primary Examiner*—H. Grant Skaggs

*Attorney, Agent, or Firm*—Staas & Halsey

[57] ABSTRACT

The invention relates to a device for dispensing a fused material. This device comprises a heating chamber, into which a rod of the material to be dispensed is progressively introduced. A clamping member is arranged so as to catch the rod. When a push is exerted on an end of the rod, the clamping member is carried away with the rod towards the heating chamber while biasing a resilient return element. When a push is no longer exerted on the rod, the last is brought rearwards under the action of the biased return element on the clamping member. This avoids untimely dispensing fused material.

11 Claims, 7 Drawing Figures

DEVICE FOR DISPENSING FUSED MATERIALS SUCH AS THERMOPLASTIC ADHESIVES

This invention relates to devices generally shaped as hand-held guns, which are used for dispensing fused materials in small amounts, for instance thermoplastic adhesives, waxes and so on.

Such devices, currently called "thermoplastic dispensers", include a heating chamber, which is provided at one end with a delivery nozzle and at the other end with an inlet tube for inserting therein a thermoplastic rod.

When pushing said rod into the heating chamber either manually or through a suitable feeding mechanism, for instance of a pneumatic or mechanical type, said rod is progressively fused down and acts at the same time as a piston for expelling the fused material through the delivery nozzle, which is generally provided with a non-return valve.

In most prior art devices of this kind, introduction of the rod in the inlet tube of the heating chamber encounters some difficulties, since this rod is not positively held by the tube inlet, which is still blocked by the end of the preceding rod. Moreover, expansion of the fused material within the heating chamber is apt to push back the rod towards the rear, so that it might extrude outside of the tube, resulting in an outward flow of fused material, which frequently happens to disable the dispenser.

If the rod is now allowed to recede back a few millimeters so as to compensate for expansion of the material under pressure within the heating chamber, this material forces its way through the non-return valve, and leaks out of the nozzle. This must be avoided.

A first object of this invention is to overcome the drawbacks just exposed.

A second object of this invention is to provide a thermoplastic dispenser, wherein the inlet tube of the heating chamber is fitted with a clamping member, arranged so as to catch the thermoplastic rod at a point located some distance upstream said inlet tube, so that said clamping member is carried away with said rod, while overcoming a resilient return force when said rod is fed, and rod is brought rearwards under the action of said resilient return force when a push is no longer exerted on said rod.

Thanks to this clamping member, the rod of the material to be dispensed is guided and supported at the entrance of the inlet tube, which makes its introduction into the dispenser easier. In addition, when a push is no longer exerted on it, the rod is brought rearwards a few millimeters, which compensates for expansion of the fused material, and even generates a slight underpressure in the heating chamber, thus providing for closing the aperture of the delivery nozzle.

The following description of the embodiments of this invention shown in the appended drawings, and given as nonlimitative examples, will help to understand this invention.

Figure 1:
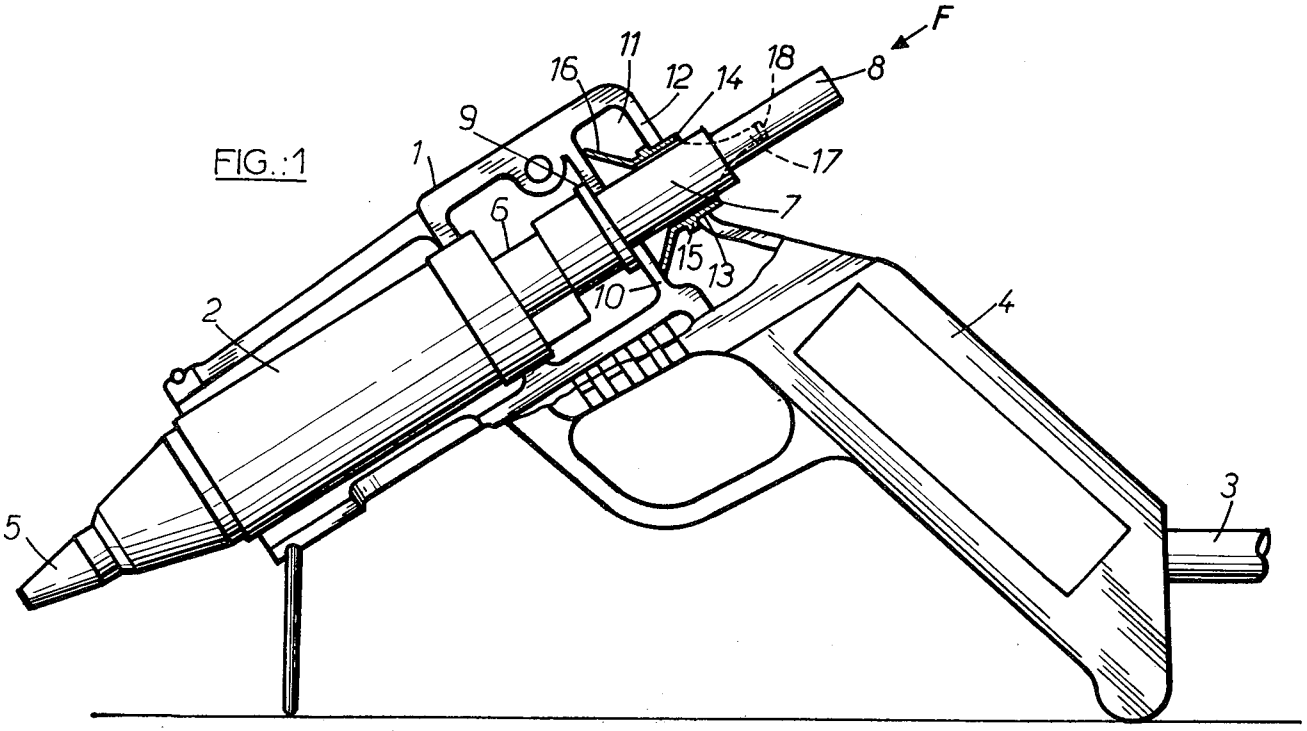
FIG. 1 is a diagrammatic view in longitudinal section of a first embodiment of the invention.
Figure 2:
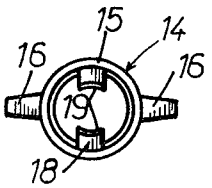
FIG. 2 is an end view of the clamping member of this first embodiment.
Figure 3:
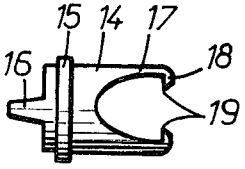
FIG. 3 is a corresponding plan view.

The embodiment shown in FIGS. 1-3 is a hand-held gun-shaped thermoplastic dispenser, which essentially comprises a housing 1. The body of this housing 1 includes a heating chamber 2, which is fed with electric power through electric conductors, which are not shown for clarification; these conductors are connected to a cable 3 which emerges from the grip 4 of the housing 1.

At the fore-part of the dispenser gun the heating chamber 2 terminates by a conventional delivery nozzle 5 fitted with a non-return valve (not shown); at its rear part the heating chamber 2 is extended by an inlet tube 6, that ends as a bush 7 made of a poor heat-conducting substance, for instance polytetrafluoroethylene. It is in this bush precisely that the rods 8 of the material to be dispensed, for instance rods of thermoplastic adhesive, are placed.

The bush 7 is formed with a collar 9, which bears against a partition 10 in the housing 1, said bush 7 having a slight fit through said partition 10.

Behind partition 10, said housing 1 includes a chamber 11, limited by wall 12, which is traversed by the rear part of bush 7, through an aperture therein with a small clearance.

Around the rear part of bush 7 a clamping member 14 is arranged. The central part of this clamping member 14 slides with a slight fit through an aperture 13, and it is formed with a collar 15 that abuts against the interior surface of wall 12.

Said central part of clamping member 14 extends within chamber 11 by diverging blades or "wings" 16, for instance two of them in number, diametrally opposed. These wings 16 are propped upon partition 10 at a sufficient distance from its edges, so that the clamping member 14 may recede in chamber 11 by moving the wings 16 elastically apart, these wings 16 brining back said clamping member 14 nearer wall 12 when no more action is exerted thereon.

Outside of chamber 11 the central part of member 14 is extended by arms 17, also two of them in number for instance, but turned by 90° with respect to the wings 16. These arms 17 end with jaws 18 formed with curved ridges 19 as shown in FIG. 2, and situated, at rest, on a circumference having a diameter inferior to those of the rods 8.

The ridges 19 are chamfered so as to facilitate insertion of the rods 8 between the jaws 18 and remain clung thereto when the rod 8 has a tendency to recede back.

The clamping member 14 is preferably made of synthetic material both rigid and resilient, for example a polyamide. It works as follows:

A rod 8 being inserted between the jaws 18, a push is given by the user on said rod 8 in the direction of arrow F. Consequently the rod 8 is moved towards the heating chamber 2 while being progressively fused and the fused material being expelled through nozzle 5 as in a conventional dispenser gun.

This forward movement of rod 8 however results in a forward displacement of the clamping member 14 together with its jaws 18 that grip the rod 8, said forward displacement being allowed for by the resilience of the wings 16. But the rod 8 may slide on the jaws 18 for penetrating into the heating chamber 2 as expulsion of the fused material proceeds through nozzle 5.

As soon as a push is no longer exerted on rod 8, the elastic wings 16 straighten and repel member 14 together with rod 8 a few millimeters in the direction opposed to arrow F.

This backward movement of rod 8 compensates for thermoplastic material expansion and generates a sucking-in in the heating chamber 2, thus avoiding any inopportune and untimely outlet flow of fused material through nozzle 5.

Also the rod 8 is thus held, correctly located, at the entrance of bush 7.

When the rod 8 has completely penetrated into bush 7, the clamping member 14 alone moves backwards. It serves then as a guide for introducing another rod.

Figure 4:
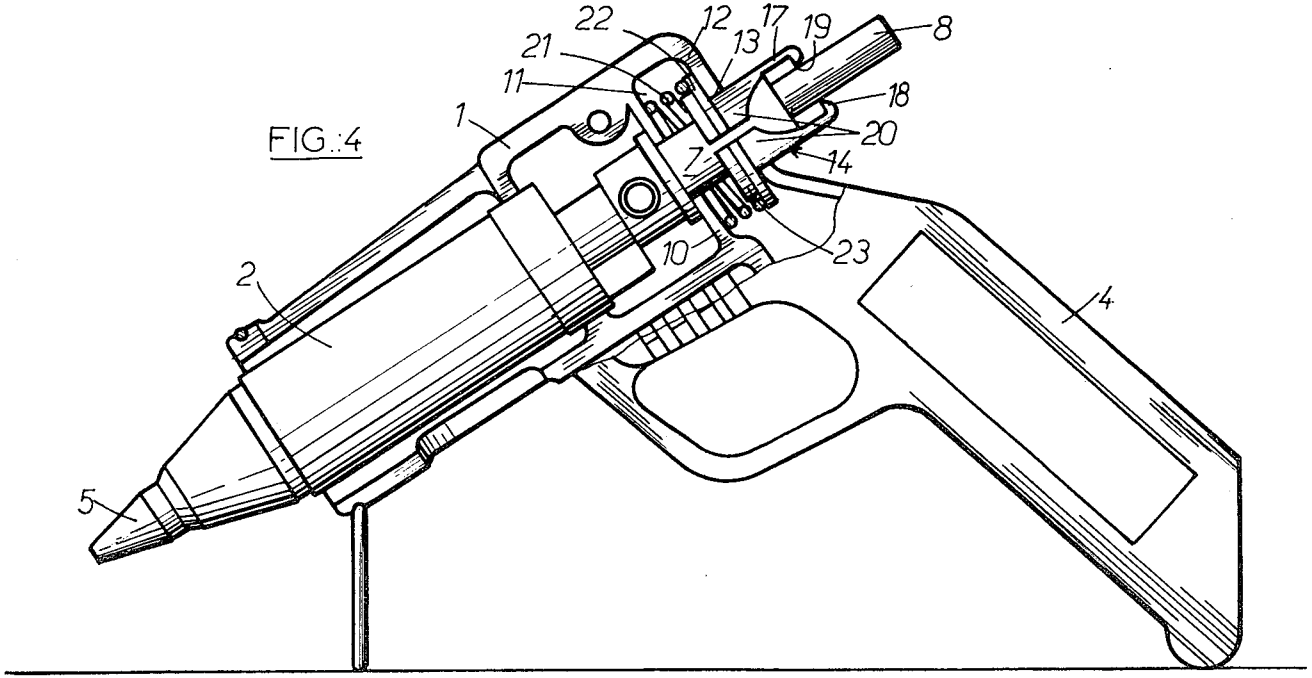
FIG. 4 is similar to FIG. 1, but with a modification of the clamping member.
Figure 5:
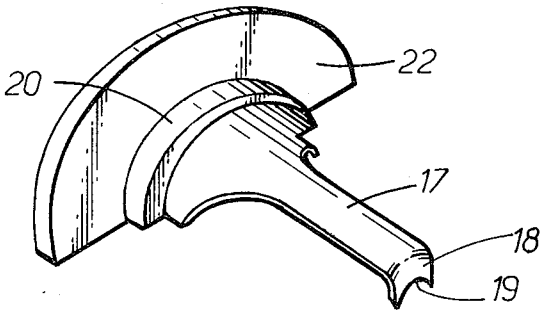
FIG. 5 is a perspective view of one of the half shells of the clamping member with this modification.

The modified embodiment of FIGS. 4 and 5 works in the same way as the one just discussed.

In this modified embodiment the clamping member 14 is made of three parts, i.e. two half shells 20 and a spring 21.

Each of the half shells 20 has an arm 17 ending with a jaw 18 provided with a chamfered ridge 19, just as exposed for the corresponding elements of the precedingly described embodiment. Their base 22 bears against wall 12 in chamber 11 under the action of spring 21 in order to achieve clamping. On the other side spring 21 abuts against partition 10 and surrounds bush 7. A centering projection 23 corresponding to spring 21 is provided at the rear of each half shell 20, that may be made of metal, for instance a light alloy.

Any of the precedingly described embodiments of the resilient clamping member 14 may be adapted to dispensers in which the rods 8 are displaced by an appropriate feeding device instead of the user's direct action as in said preceding embodiments.

Figure 6:
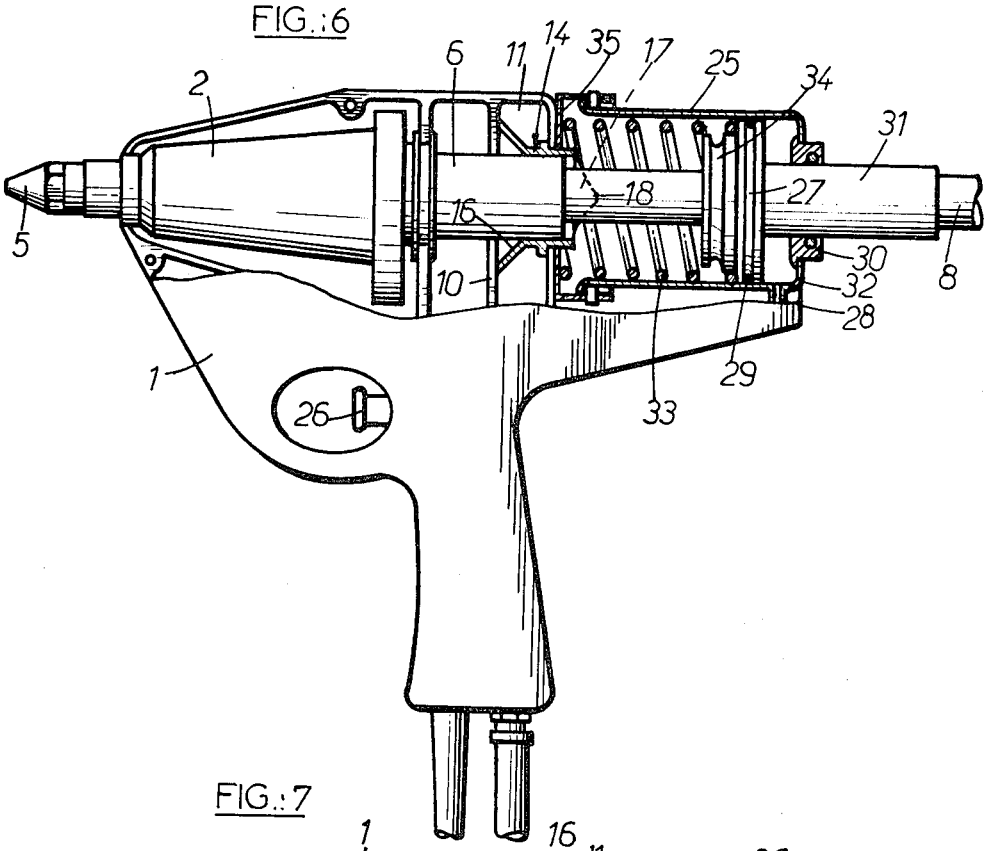
FIGS. 6 and 7 are longitudinal section views respectively illustrating two embodiments of the invention, provided with pneumatic and mechanical rod feeding means respectively.

In FIG. 6 the clamping member 14, consisting of a single piece as in FIGS. 1–3, is fixed in chamber 11 of the housing 1 between the walls 10 and 12 and on the inlet tube 6 of the heating chamber 2. Arms 17 and jaws 18 protrude in the cylinder 26 of the pneumatic feeding device for advancing the rods 8.

This pneumatic feeding device is actuated by a push-button 26 and conventionally comprises an annular piston 27 sliding in cylinder 25. The rod 8 is engaged and caught in said piston so as to be pushed forward.

Pressurized air is fed at the back of the piston 27 through a conduit 28, tightness being ensured by seals 29 and 30 that surround piston 27 and its rod 31 respectively. Said piston rod 31 extends out through the rear wall 32 of cylinder 25.

In front of the piston 27 there is disposed a return spring 33, centered by a boss 34 on the piston 27 and bearing on the front wall 35 of the cylinder 25.

The clamping device 14 resumes its normal end position and moves rod 8 back as the piston 27 covers its return stroke under the action of spring 33.

Figure 7:
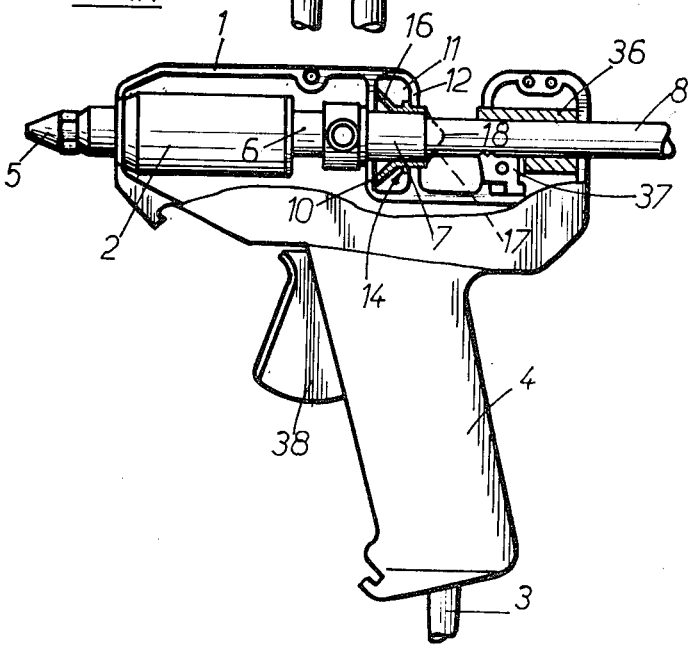

In the modification of FIG. 7, which comprises the same kind of clamping member 14 for the sake of simplification, the arrangement is the same as in FIGS. 1–3, but the housing 1 contains in its rear part a feed mechanism 36 of a conventional design.

This feed mechanism includes a toothed cam 37 capable of being moved when the user actuates a detent 38 supported in the grip 4 of the gun.

Apart from this, working of clamping member 14 is exactly the same as for FIGS. 1–3.

All the embodiments here described are but examples and are liable to modifications, all lying within the scope of the invention, as it results from the following claims.

I claim:

1. A device for dispensing a fused material such as a thermoplastic adhesive, comprising a housing equipped with a heating chamber including a delivery nozzle and an inlet tube for progressively introducing a rod of the material to be dispensed into said heating chamber, whereby the material of the introduced rod is progressively fused and expelled outside of the heating chamber through said delivery nozzle, a clamping member arranged so as to catch the rod, so that said clamping member is carried away with said rod when a push is exerted on said rod, and means for generating a resilient return force when said clamping member is carried away with said rod, so that said rod is brought rearwards under the action of said return force when a push is no longer exerted on said rod.

2. A device according to claim 1, wherein the clamping member is slidingly disposed on the inlet tube and has resilient arms that are fitted with jaws for clamping the rod at some distance upstream with respect to said inlet tube.

3. A device according to claim 2, wherein the jaws have chamfered ridges thereon for engaging the rod.

4. A device according to claim 2, wherein the clamping member includes a spring that is supported on the housing for exerting the return force.

5. A device according to claim 4, wherein the clamping member comprizes two half shells, each having thereon a base for supporting the spring, whereby the closing of the clamping jaws is produced.

6. A hand-held dispenser gun according to claim 1, wherein the open end of the inlet tube, opposed to the heating chamber, is disposed so that the user can directly push a rod of the material to be dispensed into said inlet tube, and the clamping member is mounted on the part of said inlet tube which is near to the open end thereof.

7. A device according to claim 1, which further comprises means for feeding the rod of material to be dispensed into said inlet tube.

8. A device according to claim 7, wherein the clamping member is disposed downstream of said rod feeding means.

9. A device according to claim 7, wherein the rod feeding means comprises an annular cylinder-and-piston actuator, through which the rod is engaged, and the clamping member is arranged to protrude within the cylinder of said actuator so as to catch said rod therein.

10. A device for dispensing a fused material such as a thermoplastic adhesive, comprising a housing equipped with a heating chamber including a delivery nozzle and an inlet tube for progressively introducing a rod of the material to be dispensed into said heating chamber, whereby the material of the introduced rod is progressively fused and expelled outside of the heating chamber through said delivery nozzle, a clamping member arranged so as to catch the rod, so that said clamping member is carried away with said rod when a push is exerted on said rod, and means for generating a resilient return force when said clamping member is carried away with said rod, so that said rod is brought rearwards under the action of said return force when a push is no longer exerted on said rod, the clamping member is slidingly disposed on the inlet tube and has resilient arms that are fitted with jaws for clamping the rod at some distance upstream with respect to said inlet tube, and the clamping member is formed with resilient wings for propping it upon the housing, said wings being adapted to exert the return force.

11. A device for dispensing a fused material such as a thermoplastic adhesive, comprising a housing equipped with a heating chamber including a delivery nozzle and an inlet tube for progressively introducing a rod of the material to be dispensed into said heating chamber, whereby the material of the introduced rod is progressively fused and expelled outside of the heating chamber through said delivery nozzle, a clamping member arranged so as to catch the rod, so that said clamping member is carried away with said rod when a push is exerted on said rod, and means for generating a resilient return force when said clamping member is carried away with said rod, so that said rod is brought rearwards under the action of said return force when a push is no longer exerted on said rod, and the clamping members is made of one single piece of material.

* * * * *